US006471621B2

(12) United States Patent
Hörstel et al.

(10) Patent No.: US 6,471,621 B2
(45) Date of Patent: Oct. 29, 2002

(54) METHOD OF TREATMENT OF GROUPS OF MUSCLES IN AN OROFACIAL REGION BY USING AN INFLATABLE RUBBER BALLOON AS LOGOPEDIC AID

(75) Inventors: Ulrike Hörstel, Mindelaltheim (DE); Susanne Codoni, Allschwil (CH); Barbara Rehm, Binningen (CH)

(73) Assignee: Ballon-Müller AG, Herznach (CH)

( * ) Notice: Subject to any disclaimer, the term of this patent is extended or adjusted under 35 U.S.C. 154(b) by 0 days.

(21) Appl. No.: 09/909,285

(22) Filed: Jul. 19, 2001

(65) Prior Publication Data

US 2002/0115533 A1 Aug. 22, 2002

Related U.S. Application Data

(63) Continuation-in-part of application No. 09/169,507, filed on Oct. 9, 1998, now abandoned.

(30) Foreign Application Priority Data

Oct. 9, 1997 (CH) ..... 2367/97

(51) Int. Cl.[7] ..... A63B 23/03
(52) U.S. Cl. ..... 482/11; 128/777; 128/860
(58) Field of Search ..... 482/11; 128/719, 128/717, 727, 728, 730, 777, 859, 860, 861, 725, 716

(56) References Cited

U.S. PATENT DOCUMENTS

| | | | | | |
|---|---|---|---|---|---|
| 1,586,499 | A | * | 5/1926 | Worth | 128/719 |
| 1,873,160 | A | * | 8/1932 | Sturtevant | 272/57 |
| 3,333,844 | A | * | 8/1967 | Jurschak | 272/57 |
| 4,890,609 | A | * | 1/1990 | Wilson | 128/206.29 |
| 4,945,918 | A | * | 8/1990 | Abernathy | 128/719 |
| 5,213,553 | A | * | 5/1993 | Ligh | 482/11 |
| 5,496,203 | A | * | 3/1996 | Murray | 446/222 |
| 5,924,863 | A | * | 7/1999 | Jacobs et al. | 433/80 |

FOREIGN PATENT DOCUMENTS

| | | | |
|---|---|---|---|
| GB | 2249726 | * | 5/1992 |
| GB | 2253790 | * | 9/1992 |

* cited by examiner

*Primary Examiner*—Michael A. Brown
*Assistant Examiner*—Lori Baker Amerson
(74) *Attorney, Agent, or Firm*—Sidley Austin Brown & Wood, LLP

(57) ABSTRACT

A method of treatment of groups of muscles in orofacial region, of the respiratory system, and of retaining and support system of a body of a patient and including providing a logopedic aid having at least one rubbed balloon and a plurality of valve mouthpieces for inflating the at least one rubbed balloon and characterized by different degrees of difficulty with which the balloon can be inflated, and treating the patient by having the patient inflate the balloon by using in succession valve mouthpieces with an ever increasing degree of difficulty.

2 Claims, 1 Drawing Sheet

METHOD OF TREATMENT OF GROUPS OF MUSCLES IN AN OROFACIAL REGION BY USING AN INFLATABLE RUBBER BALLOON AS LOGOPEDIC AID

RELATED APPLICATIONS

This application is a continuation-in-part of application Ser. No. 09/169,507 filed Oct. 9, 1998, now abandoned.

BACKGROUND OF THE INVENTION

The invention relates to a method of treatment of groups of muscles in the orofacial region, of the respiratory system and of the retaining and support system of the entire body by using an inflatable rubber balloon as a logopedic aid.

The subject of the invention is also suitable For the prophylaxis of hypotensions of the above-mentioned groups of muscles and various disorders in the ear, nose and throat. region, of the respiratory system and of the retaining and support system.

It is known that functional or organic speech defects, intonation defects and/or vocal defects in children and adults and dystonia in children and adults relating to the muscles in the orofacial region, in the respiratory system and in the retaining and support system of the entire body can be at least partly eliminated or the status quo improved both with the aid of behavior therapy and with apparatuses as aids.

SUMMARY OF THE INVENTION

In the development of new apparatuses as aids for logopedics, it was surprisingly found that inflatable rubber balloons having different material thickness and different valve mouthpieces are extremely suitable as medical-therapeutic aids for the treatment of groups of muscles in the orofacial region, of the respiratory system and of the retaining and support system of the entire body. A novel aid consisting of at least one rubber balloon and a plurality of different mouthpieces was, therefore, developed, by means of which, for example, at least six different degrees of difficulty can be achieved during the inflation of the balloon.

According to the present invention, there is provided a method of using a medical aid serving for the treatment of groups of muscles in the orofacial region, of the respiratory system and of the retaining and support system of the entire body, or for the prophylaxis of hypotensions of the above-mentioned groups of muscles and of various disorders in the ear, nose and throat region, of the respiratory system and of the retaining and support system, comprising at least one inflatable rubber balloon and a plurality of valve mouthpieces for inflating the rubber balloon, said mouthpieces each having a nonreturn valve and being formed in such a way as to permit training with different degrees of difficulty in inflating the rubber balloon.

The medical-therapeutic aid has at least one inflatable rubber balloon and a plurality of mouthpieces, each having a nonreturn valve for inflating the balloon. By means of such an aid, also referred to below as a set, it is possible to achieve the various, above-mentioned degrees of difficulty by training the muscles in the orofacial region.

BRIEF DESCRIPTION OF THE DRAWINGS

The invention is described in more detail below with reference to the drawings, wherein.

DETAILED DESCRIPTION OF THE PREFERRED EMBODIMENTS

Figure 1:
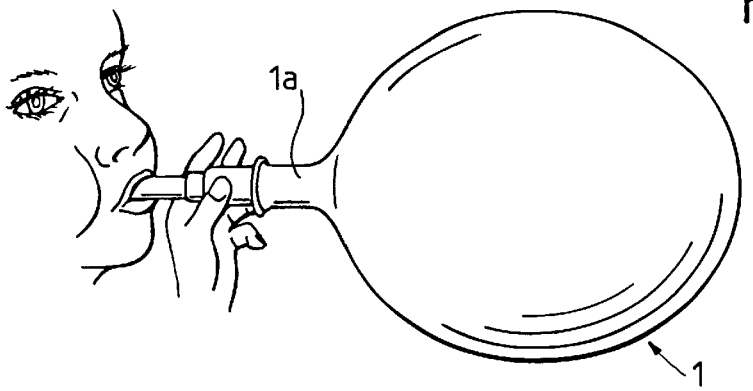
FIG. 1 shows a view of a rubber balloon used as a medico-therapeutic aid.

FIGS. 1–6 show parts of a medical therapeutic aid according to the present invention. In the present case, the therapeutic aid consists of a rubber balloon 1 having a neck 1*a*, and five different valve mouthpieces 2, 3, 4, 5, and 6.

As is evident from the drawings, the essentially cylindrical mouthpieces 2, 3, 4 and 5 are formed from three different components, namely a base part 7 having the nonreturn valve, a front cone attachment 8 and a tube attachment 9. The non-return valve is formed of grating 7' (FIG. 5) and a membrane 7' arranged near the respiratory air inlet 7*b*. Thus, the valve mouthpiece 2 formed only from the base part 7 constitutes a first level difficulty, and the valve mouthpiece 3 formed from the base part 7 and a front cone attachment 8 detachably mounted on the base part constitutes a second level of difficulty.

Figure 2:
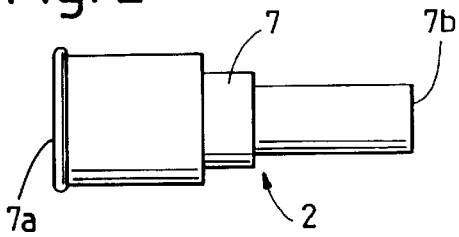
FIGS. 2 and 3 each shows a first and second mouthpiece.

As shown in particular in FIG. 2, the base part 7 has a respiratory air outlet 7*a* insertabe into the balloon neck la and a respiratory air inlet 7*b*. When the valve mouthpieces 2 and 3 are used, the respiratory air inlet 7*b* is placed by the patient in front of the teeth, enclosed with the lips and blown up, as shown in FIG. 1.

The valve mouthpieces 4 and 5 are further developments of the valve mouthpieces 2 and 3 and, for increasing the degree of difficulty, additionally have a connecting tube 9 which extends the respiratory air inlet 7*b*. Like the front cone attachment 8, said connecting tube is detachably mounted on the base part 7. The valve mouthpieces 4 and 5 thus each constitutes a further level of difficulty.

Figure 6:
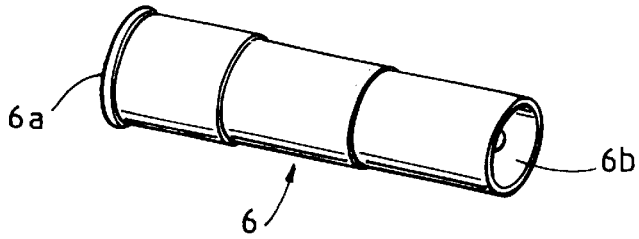
FIG. 6 shows a fifth mouthpiece.

The valve mouthpieces shown in FIGS. 2–5 preferably are formed of plastic. The individual components of the valve mouthpieces may be formed in different colors. However, they can also be transparent and thus, when used by the patient, indicate to the therapist whether, saliva is released when inflating the balloon, and, if so, how much.

Where the valve mouthpieces 2–5 cannot be used due to a high level of hypotension of the lips or owing to a shortened upper lip or because of the patient's individual perception of degrees of difficulty or owing to organic lip dysfunction, according to the invention, valve mouthpieces having a vent piston are used. Such a valve mouthpiece known per se is shown in FIG. 6. This valve mouthpiece 6, too has a respiratory air outlet 6*a* insertabe into the balloon neck and a respiratory air inlet 6*b* and preferably consists of colored or transparent plastic.

When the set shown is FIGS. 1–6 is used, the various levels of difficulty are passed through in succession with the balloon 1 by means of training. The individual variable in the patient's perception of difficulty should be observed. It is then possible to use the valve mouthpeices 2–5 and optionally also the valve mouthpiece 6 with a second, thicker-wall rubber balloon, for example with a marbled balloon, the same sequence, corresponding to the patient's individual perception of difficulty, of the levels of difficulty dependent on the type of valve mouthpieces used then once again being complied with.

A set according to the invention may, therefore, contain not just one single rubber balloon but a plurality of balloons which differ in their wall thickness and thus correspondingly increase the number of levels of difficulty.

It should be pointed out that the set described with reference to FIGS. 1–6 represents only a selection of various embodiments of the invention.

For example, the valve mouthpieces which can be used according to the invention may differ in shape and size from the valve mouthpieces shown, and a set according to the invention may of course contain not just five valve mouthpieces but a smaller or larger number of valve mouthpieces.

The utilization of a set pursuant to the invention which has shown to be especially effective under practical condition is described in detail below.

The set is comprised of 1 to 3 monochrome (double-walled) and 1 to 3 multicolored (marbled, triple-walled) balloons and 5 valve mouthpieces. The two types of balloons of this set exhibit different material thicknesses; however, they differ also from conventional balloons, which are generally single-walled. The valve mouthpieces are:

Valve I=Valve 3 pursuant to FIG. 2

Figure 4:
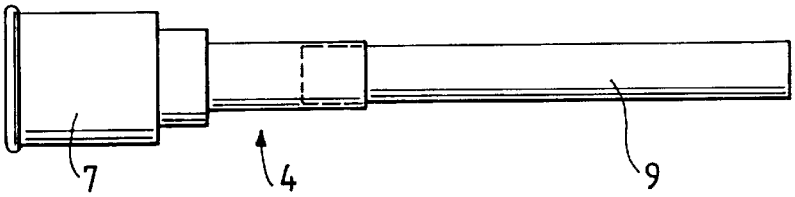
FIGS. 4 and 5 each shows a third and fourth mouthpiece.

Valve II=Valve 4 pursuant to FIG. 4

Figure 3:
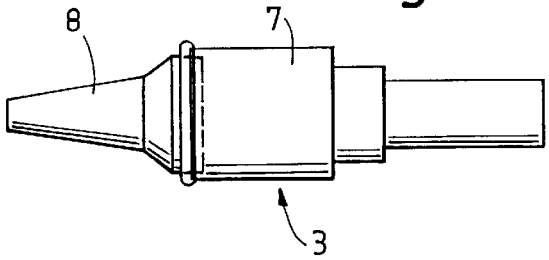

Valve III=Valve 3 pursuant to FIG. 3

Figure 5:
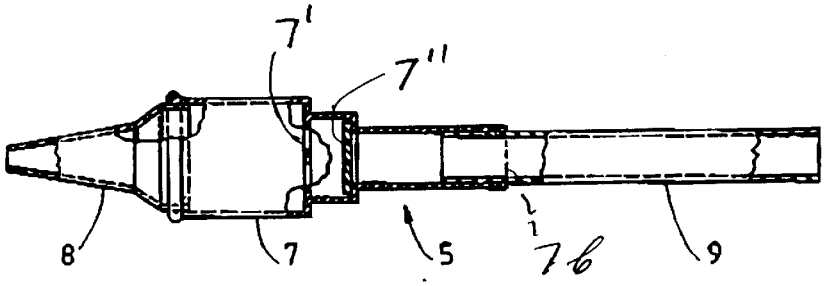

Valve IV=Valve 5 pursuant to FIG. 5

Valve V=Valve 6 pursuant to FIG. 6, transparent

The set can be utilized as described below:

| Preventive Applications | Therapeutic Applications |
|---|---|
| For the prevention of infections in the area of the upper and lower respiratory tract and the organs of audition | In functional and/or organic disorders and impairments of speech, articulation, and/or vocalization |
| As a stabilization measure and for the prevention of pneumonia before/after surgical procedures | In tonic dysregulation of the orofacial musculature, of the respiratory and the support apparatus in the range of the entire body |
| For the enhancement of bronchial toilet in bronchopulmonary diseases of various causes | In hypersalivation and/or limited control of salivation |
| For the prevention of pneumonia immobile patients | For reinforcement of the velum incheilognatho-[palato/urano]schithis |
| For prophylactic application as an adjuvant therapy in osteo-, myo- and neurogenic tonic dysregulation | In chronic, organic or medicinally (e.g., neuroleptics) induced open-mouth or mouth-breathing<br>For enhancement of whole-body tonus in patients with limited motility<br>In disturbances of various etiologies affecting the retention of bronchial secretions |

The exercises are started using a monochrome; that is, a thin balloon. The criteria for the employment of a specific valve on first-time use are summarized in the table below:

| Valve I | Valve II | Valve V |
|---|---|---|
| The Patient has no problem with saliva control | If, when blowing with Valve I, it becomes apparent, that "it is difficult," for example, by raising the shoulders, projection of the neck muscles, bending the upper body back and/or tucking the head into the neck. | Particularly suitable for patients with an extremely hypotonic and/or shortened upper lip. |
| The patient has minimally active mentalis muscles | The patient reports that s/he has difficulty inflating [the balloon]<br>These indicators can appear individually or in combination; otherwise, all the criteria for Valve I apply. | Particularly appropriate for patients who require a generally greater stimulus for stimulation of tonicity<br>With clearly hypotonic labial musculature<br>Grimacing on swallowing<br>Hyperactive mentalis muscle<br>In the presence of limited saliva control, with hypersalivation |

After selection of the valve mouthpiece, the blowing technique is practice, for example, as follows: The patient bites down lightly with the lips initially open.

Meanwhile, the therapist checks that the lower jaw is not thrust forward. The patient then places the valve in front of the teeth and forms a purse (=the lips are pointed forward) and then surrounds the valve with the lips and blows. When doing this, the patient must breathe in through the nose and encircle the valve with the lips and blow. When doing this, the patient must breathe in through the nose and encircle the valve with lips. The therapist checks whether abdominal breathing is begun and assures that breathing occurs in a regular rhythm. She checks that the patient loosely closes the teeth. After the $3^{rd}$ forced expiration the patient should support the balloon from below using his/her free hand.

Additional preliminary exercises using the clear Valve 5 (6) are necessary for patients with saliva problems. Using said valve, the therapist can observe whether, and if so, how much saliva is discharged during inflation. If the problem is severe, practice is initially done with the balloon for as long as is required to be able to produce 5 consecutive "dry" forced exhalations through Valve V.

After successful practice of the blowing technique, the patient can start independent practice, whereby Valves I–V provide a variable increase in inflation resistance, taking into account the individual capacity of the patient.

The therapeutic effect or effective prophylaxis is thus provided.

The selection valve is used until the balloon is easily inflated in 6–10 uninterrupted forced expirations.

The degree of difficulty during inflation is initially increased by changing valves, whereby the level of difficulty increases for I–V. When the level of difficulty can no longer be increased, the multicolored, marbled balloons are used. When this is done, valve selection is again necessary, beginning with Valve 1 (2). The level of difficulty is again increased by the appropriate change of valve.

The system is always exercised using abdominal breathing in the standing position, without shoes and in front of a large mirror. The lips close (loosely) around the valve for the duration of the forced expiration. The forced expiration must be produced without involvement of the buccinator muscles. Generally, the inventive system is used until spontaneous lip closure and-this applies to myofunctional therapy appropriate tonus in the orofacial musculature is obtained.

Regular practice is essential. In myofunctional therapy, having the patient inflate one balloon several times using at least one valve approximately 1–2× weekly individual exercise has been shown to be effective.

The duration of the individual exercises varies depending on the starting situation and must be adapted to the individual patient.

Though the present invention was shown and described with reference to the preferred embodiments, various modifications of the present invention will be apparent to those skilled in the art and therefore, it is not embedded that the invention be limited to the disclosed embodiment and for details thereof, and the present invention includes all variations and/or alternative embodiments within the spirit and scope of the present invention as defined by appended claims.

What is claimed is:

1. A method of treatment for groups of muscles in orofacial region, of the respiratory system, and of retaining and support system of a body of a patient for prophylaxis of hypotensions of above-mentioned groups of muscles and of disorders in the orofacial region, the respiratory system, and the retaining and support system, the method comprising the steps of:

providing a logopedic aid having at least one rubber balloon and a plurality of valve mouthpieces for inflating the at least one rubber balloon and where said mouthpieces are characterized by different degrees of difficulty with which the balloon can be inflated;

evaluating patient's saliva control and orofacial muscles activity; selecting, from the plurality of valve mouthpieces, a valve mouthpiece corresponding to the patients saliva control and orofacial muscles activity; and treating the patient by having the patient inflate the at least one balloon, first, with the selected valve mouthpiece and then by using at least one further valve mouthpiece from the plurality of valve mouthpieces and having an increased degree of difficulty of inflating the at least one balloon in comparison with a degree of difficulty of inflating the at least one balloon with the selected valve mouthpiece.

2. A method as set forth in claim 1, wherein the logopedic aid providing step comprises the step of providing a logopedic aid having a plurality of balloons with different thickness of material of wall of respective balloons, and wherein the treating step comprises the step of having the patient inflate, with the selected valve mouthpiece and then with at least one further valve mouthpiece, first, a balloon having a smallest thickness of the wall material and then at least one further balloon from the plurality of balloons and having an increased thickness of the wall material.

* * * * *